United States Patent [19]

Daughton et al.

[11] Patent Number: 5,017,972

[45] Date of Patent: May 21, 1991

[54] ELEVATOR TRAY POSITION CONTROL APPARATUS

[75] Inventors: John W. Daughton, Rochester; Jack E. Jones, Macedon; Michael L. Shaffer, Walworth, all of N.Y.

[73] Assignee: Xerox Corporation, Stamford, Conn.

[21] Appl. No.: 532,282

[22] Filed: May 30, 1990

[51] Int. Cl.[5] ..... G03G 21/00

[52] U.S. Cl. ..... 355/321; 271/217; 355/322

[58] Field of Search ..... 355/308, 321, 322, 324; 271/217, 215; 414/907

[56] References Cited

U.S. PATENT DOCUMENTS

| | | | |
|---|---|---|---|
| 4,068,939 | 1/1978 | Bullock et al. | 271/217 X |
| 4,134,672 | 1/1979 | Burlew et al. | 355/324 |
| 4,359,218 | 11/1982 | Karis | 271/188 |
| 4,371,254 | 2/1983 | Beery | 355/8 |
| 4,424,963 | 1/1984 | Bartholet et al. | 355/324 X |
| 4,449,812 | 5/1984 | Furuichi et al. | 355/321 |
| 4,466,604 | 8/1984 | Kishimoto et al. | 271/111 |
| 4,479,641 | 10/1984 | Bean et al. | 270/53 |
| 4,664,507 | 5/1987 | Fukae et al. | 271/217 X |
| 4,838,480 | 6/1989 | Takahashi et al. | 271/217 X |
| 4,905,055 | 2/1990 | Higaki | 355/324 |
| 4,951,935 | 8/1990 | Oikawa | 271/217 X |

*Primary Examiner*—A. T. Grimley

*Assistant Examiner*—Nestor R. Ramirez

*Attorney, Agent, or Firm*—H. Fleischer; J. E. Beck; R. Zibelli

[57] ABSTRACT

An apparatus for maintaining the outermost surface of a stack of sheets at a selected elevation of the type having a stacking tray for holding the stack, a drive system adapted to move the tray, a position sensor for detecting the position of the outermost sheet of the stack, and a drive controller for controlling the drive system in response to signals received from the position sensor. The drive controller utilizing signals generated by a travel limit sensor, whereby the sensor indicates, with an active signal, the presence of the stacking tray at either a first or a second travel limit position. The drive controller further utilizing signals generated by a motion sensor, whereby the sensor signal is indicative of displacement of the stacking tray. The apparatus further including a sensor actuating apparatus, operatively connected to the stacking tray, for actuating the travel limit and motion sensors. The sensor actuating apparatus including means for actuating the travel limit sensor when the stacking tray is in either a first or a second travel limit position. The sensor actuating apparatus further including means for periodically actuating the motion sensor in response to movement of the stacking tray, thereby causing the motion sensor to generate a signal indicative of movement of the stacking tray.

18 Claims, 3 Drawing Sheets

ELEVATOR TRAY POSITION CONTROL APPARATUS

This invention relates generally to an electrophotographic printing machine, and more particularly concerns an apparatus for maintaining a stack of sheets at a desired position.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In a high speed commercial printing machine of the foregoing type, large volumes of sets of finished copy sheets are fed onto a stacking tray. In order to uniformly stack the copy sheets in a rapid manner, it is necessary to maintain the supporting surface, be it the surface of the empty tray or the upper surface of the previous copy sheet, within an established elevation range. By doing so, each copy sheet or set will undergo the same relative vertical displacement upon exiting the finishing station of the machine. Control of the vertical displacement of the copy sheets upon exiting the machine reduces the complexity of the stacking tray and enables output to occur at a higher rate without impact to the uniformity of the copy sheet stack.

Various approaches have been devised for controlling the elevation of the stacking tray. The following disclosures appear to be relevant:

U.S. Pat. No. 4,359,218
Patentee: Karis
Issued: Nov. 16, 1982

U.S. Pat. No. 4,371,254
Patentee: Beery
Issued: Feb. 1, 1983

U.S. Pat. No. 4,466,604
Patentee: Kishimoto et al.
Issued: Aug. 21, 1984

U.S. Pat. No. 4,479,641
Patentee: Bean et al.
Issued Oct. 30, 1984

The relevant portions of the foregoing patents may be summarized as follows:

Karis describes a sheet collection and discharge system. Sheets continuously accumulate at a stacker station. A table supported for vertical movement on scissor type collapsible legs receives the sheets. The table has a base platform element, the under surface of which is formed with connection pieces to which the upper ends of the support legs are attached. A series of spaced apart columns extend vertically from the upper surface of the table platform. Each column is generally rectangular with a longitudinal axis parallel to the longitudinal axis of the apparatus. The upper surfaces of the columns support the stack of sheets at the stacker station. Interspaced between the table carrying columns are a series of lateral belt conveyors driven by a motor through a series of rollers. The belt conveyors discharge sheets in a batch onto a discharge table surface after the upper carrying surfaces of the table have descended beneath the level of the conveyor belts.

Beery describes a programmed brake for controlling the deceleration of a scanning carriage, including an electro-optic sensor mounted on a moving carriage together with a stationary grating having a plurality of unevenly spaced apertures. A clocking mechanism in conjunction with an encoder, electrically connected to the sensor, provides velocity data of the rate of relative movement of the carriage with respect to the grating. In particular, the velocity of the carriage is controlled by sensing the number of clock pulses occurring during each encoder step and adjusting the velocity of the carriage to maintain a relatively constant number of clock pulses for each step. Varying the spacing of the apertures therefore results in a corresponding alteration of carriage velocity.

Kishimoto et al. discloses an elevator type paper feeding apparatus having a vertically movable paper tray, a switch for detecting the fully raised sheet feeding condition of the tray and a photosensor for detecting the presence of paper on the tray. The switch is responsive to the presence of the upper sheet of the copy sheet stack, and is utilized to control the ascent of the tray accordingly. Actuation of the switch causes the tray to stop any further upward movement. Subsequently feeding copy sheets from the top of the stack causes the triggering of the switch, thereby initiating further ascent of the tray until the switch is once again actuated.

Bean et al. teaches a paper handling system for use with a duplicating machine. Paper sheets are collected into sets and are transported to a finishing station where they are bound into pamphlets. The sheets are then stacked on a tray at a stacking station and moved to a discharge station. A discharge conveyor transports stacked sheets to a shelf for removal. The discharge station includes a discharge conveyor system which consists of a pair of belts which may run from the tray to the end of the discharge station. Rollers located within the stacker, extend upwardly through the tray to displace a stack of pamphlets to the conveyor system.

In accordance with one aspect of the present invention, there is provided an apparatus for maintaining the outermost sheet of a stack of sheets at a selected position of the type having a tray for holding the stack, a drive system adapted to move the tray, a position sensor for detecting the outermost sheet of the stack, and means for controlling the drive system in response to signals received from the position sensor. The apparatus includes first means for sensing the tray at a first selected position and at a second selected position, spaced from the first selected position, whereby the first sensing means transmits a signal to the controlling means indicating that the tray is at the first selected position or the second selected position, such that the controlling means inhibits movement of the tray and causes the drive system to reverse the direction of subsequent movement of the tray. Second sensing means for sensing motion of the tray, whereby a signal indicative of movement of the tray, is sent from the second sensing means to the controlling means. First means, operatively connected to the tray, for actuating the first sensing means when the tray reaches the first selected position or the second selected position. Second means, operatively connected to the tray, for actuating the second sensing means, so that the second sensing means, responsive to movement of the tray, transmits an alternating binary signal, indicative of movement of the tray, to the controlling means enabling the controlling means to monitor the location of the tray.

Pursuant to another aspect of the features of the present invention, there is provided an electrophotographic printing machine of the type in which successive copy sheets, having indicia recorded thereon are advanced to a finishing station having a tray for holding a stack of the copy sheets, a drive system adapted to move the tray in a vertical direction, a position sensor detecting the position of the uppermost copy sheet of the stack of the copy sheets on the tray, and means for controlling the drive system in response to signals received from the position sensor so as to maintain the uppermost copy sheet of the stack at a predetermined location. The printing machine includes first means for sensing the tray at a first selected position and at a second selected position, spaced from the first selected position, the first sensing means transmitting a signal to the controlling means indicating that the tray is at the first selected position or the second selected position, which inhibits movement of the tray and causes the drive system to reverse the direction of subsequent movement of the tray. Second means for sensing motion of the tray, whereby a signal, indicative of movement of the tray, is sent from the second sensing means to the controlling means. First means, operatively connected to the tray, for actuating the first sensing means when the tray reaches the first selected position or the second selected position. Second means, operatively connected to the tray, for actuating the second sensing means, so that the second sensing means, responsive to movement of the tray, transmits an alternating binary signal, indicative of movement of the tray, to the controlling means enabling the controlling means to monitor the location of the tray.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents, as may be included within the spirit and scope of the invention as defined by the appended claims.

Figure 1:
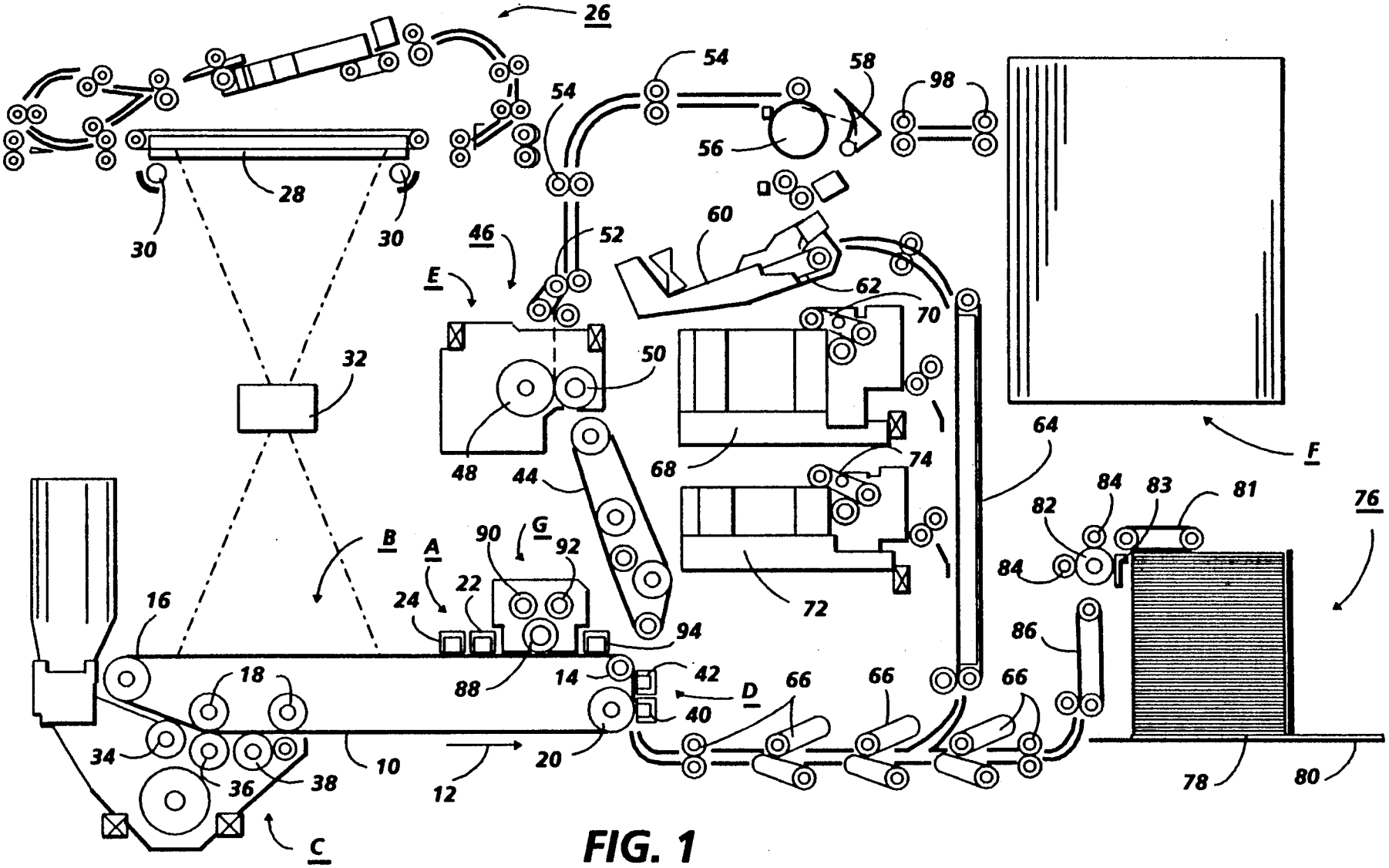
FIG. 1 is a schematic elevational view depicting an illustrative electrophotographic printing machine incorporating a finisher having the apparatus of the present invention therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the apparatus of the present invention may be employed in a wide variety of devices and is not specifically limited in its application to the particular embodiment depicted herein.

Referring to FIG. 1 of the drawings, the electrophotographic printing machine employs a photoconductive belt 10. Preferably, the photoconductive belt 10 is made from a photoconductive material coated on a ground layer, which, in turn, is coated on an anti-curl backing layer. The photoconductive material is made from a transport layer coated on a generator layer. The transport layer transports positive charges from the generator layer. The interface layer is coated on the ground layer. The transport layer contains small molecules of di-m-tolydiphenylbiphenyldiamine dispersed in a polycarbonate. The generation layer is made from trigonal selenium. The grounding layer is made from a titanium coated Mylar. The ground layer is very thin and allows light to pass therethrough. Other suitable photoconductive materials, ground layers, and anti-curl backing layers may also be employed. Belt 10 moves in the direction of arrow 12 to advance successive portions of the photoconductive surface sequentially through the various processing stations disposed about the path of movement thereof. Belt 10 is entrained about stripping roller 14, tensioning roller 16, idler rollers 18, and drive roller 20. Stripping roller 14 and idler rollers 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surface passes through charging station A. At charging station A, two corona generating devices, indicated generally by the reference numerals 22 and 24, charge photoconductive belt 10 to a relatively high, substantially uniform potential. Corona generating device 22 places all of the required charge on photoconductive belt 10. Corona generating device 24 acts as a leveling device, and fills in any areas missed by corona generating device 22.

Next, the charged portion of the photoconductive surface is advanced through imaging station B. At imaging station B, a document handling unit, indicated generally by the reference numeral 26, is positioned over platen 28 of the printing machine. Document handling unit 26 sequentially feeds original documents from a stack of documents placed by the operator face up in a normal forward collated order in the document stacking and holding tray. A document feeder located below the tray forwards the bottom document in the stack to a pair of take-away rollers. The bottom sheet is then fed by the rollers through a document guide to a feed roll pair and belt. The belt advances the document to platen 28. After imaging, the original document is fed from platen 28 by the belt into a guide and feed roll pair. The document then advances into an inverter mechanism and back to the top of the stack of original documents through the feed roll pair. A position gate is provided to divert the document to the inverter or to the feed roll pair. Imaging of a document is achieved by lamps 30 which illuminate the document on platen 28. Light rays reflected from the document are transmitted through lens 32. Lens 32 focuses light images of the original document onto the charged portion of photoconductive belt 10 to selectively dissipate the charge thereon. This records an electrostatic latent image on the photoconductive belt which corresponds to the informational areas contained within the original document. In this way, a plurality of original documents may be sequentially exposed. Alternatively, document handling unit 26 may be pivoted away from platen 28 and an original document positioned manually thereon. One or more copies of the original document may be reproduced by the printing machine. The original document is exposed and a latent image recorded on the photoconductive belt. Thereafter, belt 10 advances the electrostatic latent image recorded thereon to development station C.

Development station C has three magnetic brush developer rolls, indicated generally by the reference numerals 34, 36 and 38. A paddle wheel picks up developer material and delivers it to the developer rolls. When developer material reaches rolls 34 and 36, it is magnetically split between the rolls with half the developer material being delivered to each roll. Photoconductive belt 10 is partially wrapped about rolls 34 and 36 to form extended development zones. Developer roll 38 is a cleanup roll. A magnetic roll, positioned after developer roll 38, in the direction of arrow 12, is a carrier granule removal device adapted to remove any carrier granules adhering to belt 10. Thus, rolls 34 and 36 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet is moved into contact with the toner powder image. First, photoconductive belt 10 is exposed to a pretransfer light from a lamp (not shown) to reduce the attraction between photoconductive belt 10 and the toner powder image. Next, a corona generating device 40 charges the copy sheet to the proper magnitude and polarity so that the copy sheet is tacked to photoconductive belt 10 and the toner powder image attracted from the photoconductive belt to the copy sheet. After transfer, corona generator 42 charges the copy sheet to the opposite polarity to detack the copy sheet from belt 10. Conveyor 44 advances the copy sheet to fusing station E.

Fusing station E includes a fuser assembly, indicated generally by the reference numeral 46 which permanently affixes the transferred toner powder image to the copy sheet. Preferably, fuser assembly 46 includes a heated fuser roller 48 and a pressure roller 50 with the powder image on the copy sheet contacting fuser roller 48. The pressure roller is cammed against the fuser roller to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent transfers to a donor roll and then to the fuser roll.

After fusing, the copy sheets are fed through a decurler 52. Decurler 52 bends the copy sheet in one direction to put a known curl in the copy sheet and then bends it in the opposite direction to remove that curl.

Forwarding rollers 54 then advance the sheet to duplex turn roll 56. Duplex solenoid gate 58 guides the sheet to the finishing station F or to duplex tray 60. At finishing station F, copy sheets are stacked in compiler trays to form sets of copy sheets. The sheets of each set are optionally stapled to one another. The sets of copy sheets are then delivered to a stacking tray. In the stacking tray, each set of copy sheets may be offset from an adjacent set of copy sheets. Further details of finishing station F will be described hereinafter with reference to FIG. 2.

With continued reference to FIG. 1, when duplex solenoid gate 58 diverts the sheet into duplex tray 60. Duplex tray 60 provides an intermediate or buffer storage for those sheets that have been printed on one side and on which an image will be subsequently printed on the second, opposed side thereof, i.e. the sheets being duplexed. The sheets are stacked in duplex tray 60 face down on top of one another in the order in which they are copied.

In order to complete duplex copying, the simplex sheets in tray 60 are fed, in seriatim, by bottom feeder 62 from tray 60 back to transfer station D via conveyor 64 and rollers 66 for transfer of the toner powder image to the opposed sides of the copy sheets. Inasmuch as successive bottom sheets are fed from duplex tray 60, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets are fed to transfer station D from the secondary tray 68. The secondary tray 68 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 70. Sheet feeder 70 is a friction retard feeder utilizing a feed belt and take-away rolls to advance successive copy sheets to transport 64 which advances the sheets to rolls 66 and then to transfer station D.

Copy sheets may also be fed to transfer station D from the auxiliary tray 72. The auxiliary tray 72 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 74. Sheet feeder 74 is a friction retard feeder utilizing a feed belt and take-away rolls to advance successive copy sheets to transport 64 which advances the sheets to rolls 66 and then to transfer station D.

Secondary tray 68 and auxiliary tray 72 are secondary sources of copy sheets. A high capacity feeder, indicated generally by the reference numeral 76, is the primary source of copy sheets. High capacity feeder 76 includes a tray 78 supported on an elevator 80. The elevator is driven by a bidirectional AC motor to move the tray up or down. In the up position, the copy sheets are advanced from the tray to transfer station D. A fluffer and air knife 83 direct air onto the stack of copy sheets on tray 78 to separate the uppermost sheet from the stack of copy sheet. A vacuum pulls the uppermost sheet against feed belt 81. Feed belt 81 feeds successive uppermost sheets from the stack to an take-away drive roll 82 and idler rolls 84. The drive roll and idler rolls guide the sheet onto transport 86. Transport 86 advances the sheet to rolls 66 which, in turn, move the sheet to transfer station station D.

Invariably, after the copy sheet is separated from the photoconductive belt 10, some residual particles remain adhering thereto. After transfer, photoconductive belt 10 passes beneath corona generating device 94 which charges the residual toner particles to the proper polarity. Thereafter, the pre-charge erase lamp (not shown), located inside photoconductive belt 10, discharges the photoconductive belt in preparation for the next charging cycle. Residual particles are removed from the photoconductive surface at cleaning station G. Cleaning station G includes an electrically biased cleaner brush 88 and two de-toning rolls 90 and 92, i.e. waste and reclaim de-toning rolls. The reclaim roll is electrically biased negatively relative to the cleaner roll so as to remove toner particles therefrom. The waste roll is electrically biased positively relative to the reclaim roll so as to remove paper debris and wrong sign toner particles. The toner particles on the reclaim roll are scraped off and deposited in a reclaim auger (not shown), where it is transported out of the rear of cleaning station G.

The various machine functions are regulated by a controller. The controller is preferably a programmable microprocessor which controls all of the machine fuctions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the documents and the copy sheets. In addition, the controller regulates the various positions of the gates depending upon the mode of operation selected.

Figure 2:
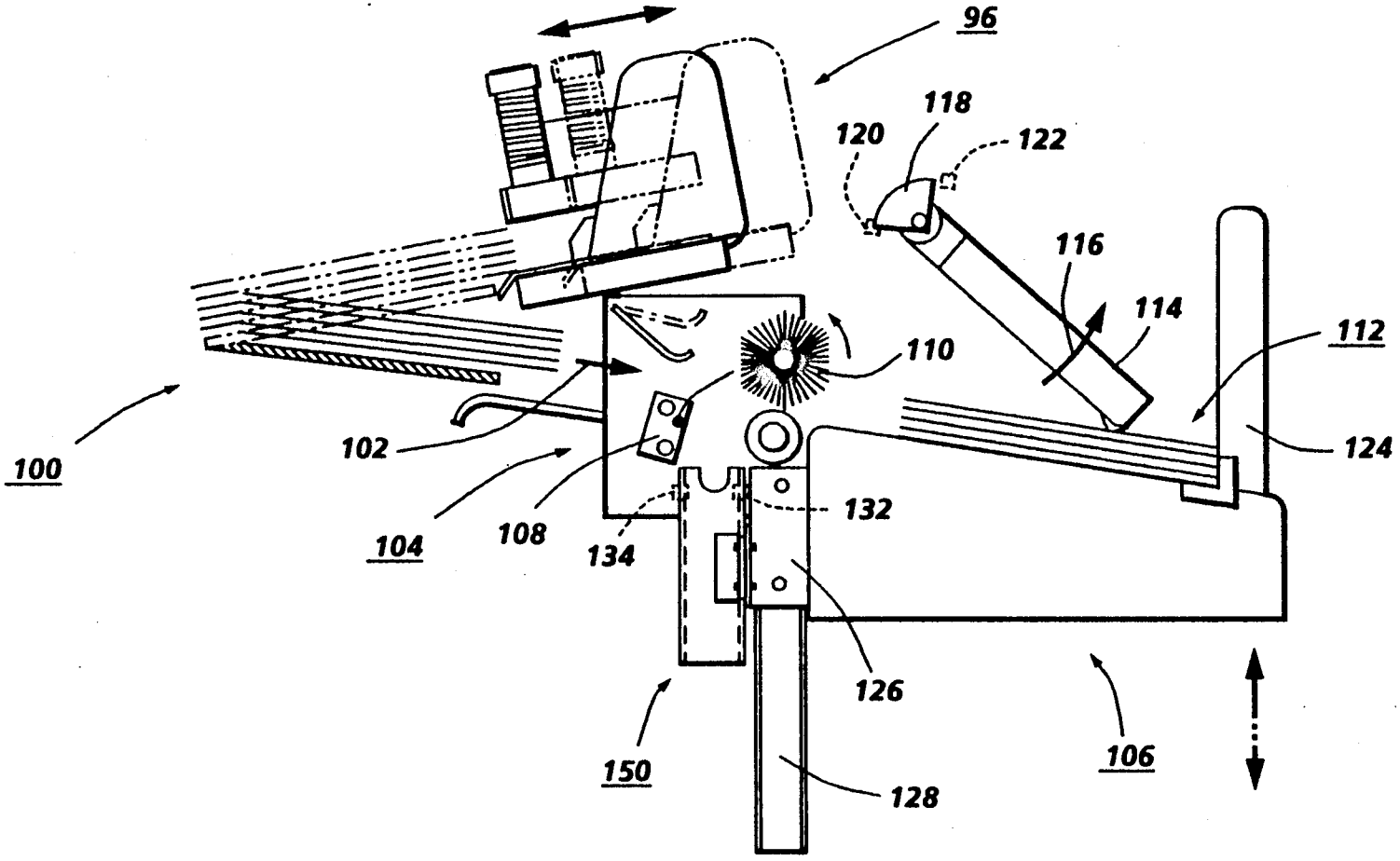
FIG. 2 is a schematic elevational view showing the finishing station of the FIG. 1 printing machine.

Referring now to FIG. 2, the general operation of finishing station F will now be described. Finishing station F receives fused copies from rolls 98 (FIG. 1) and advances them in the direction of arrow 102 to the compiler tray, indicated generally by the reference numeral 100. Compiler tray 100 has two positions, an upper position and a lower position. Compiler tray 100 is normally located in the lower position to enable the passage of copy sheets, however, when the staple option is selected, the compiler tray moves to the upper position in order to compile a set of copy sheets. If the stapling option is selected, after the set of copy sheets has been compiled on tray 100, a stapler, indicated generally by the reference numeral 96 moves from a non-operative position remote from the set of copy sheets to an operative position adjacent an edge of the set of copy sheets. Subsequently, the stapler staples the set of copy sheets and the compiler tray is lowered. The stapled set of copy sheets is then ejected and the compiler tray raises to the upper position ready to compile the next set of copy sheets for stapling.

Individual copy sheets, or sets of copy sheets, are ejected into the output transport assembly, indicated generally by the reference numeral 104, which subsequently drives the copy sheets out of compiler tray 100 into stacking tray 106. Output switch 108 senses each set of copy sheets as it leaves compiler tray 100. Output switch 108 informs the controller if a jam occurs. If a jam does occur, the controller then declares a fault code. Sets of copy sheets can range in thickness from about two sheets to one hundred sheets. Because of the wide range of sheet sizes and the varying thicknesses of the sets of copy sheets, hexagonal shaped brushes 110 are used to provide a uniform nip force to drive the copy sheets to stacking tray 106. Additionally, due to the high volume capability of the electrophotographic printing machine, stacking tray 106 has the capacity to hold approximately 1500 copy sheets, thereby reducing the frequency with which an operator must remove the output copy sets. Upon exiting output transport assembly 104, copy sheets are pushed onto the top surface of a stack of sheets 112, previously output to stacking tray 106. Damper arm 114 restricts the movement of the sheets arriving at stacking tray 106, thus preventing them from becoming misaligned within the stacking tray. The damper arm is also responsive to the position of the top of stack 112 and moves in the direction indicated by arrow 116 as additional sheets are fed into the stacking tray. Centered about the axis of rotation of the damper arm, is stack top sensor actuator 118. The stack top sensor actuator is operatively connected to the damper arm so that the angle of rotation of the damper arm is equivalently reflected by rotation of the stack top sensor actuator. Optical switches function as upper and lower stack top range sensors, 120 and 122 respectively, and are responsive to the presence of actuator 118 within their respective active regions. The range of elevations allowed for the top of the sheet stack is controlled by stack top range sensors 120 and 122, to enable the rapid output of copy sheet sets in a uniform fashion. The stack top elevation range will enable the copy set to travel over the top of stack 112, while maintaining an acute angle of impact between the copy sheet set and damper arm 114. Regulating the stacking tray elevation in this fashion assures that each output copy set will travel across the top of stack 112 and reach outer stop 124. For this reason, the vertical position of stacking tray 106 is controlled in response to signals from the upper and lower stack top range sensors. Furthermore, stacking tray 106 is attached to slide 126, whereby the slide and the attached stacking tray are constrained to move in a vertical direction by slide rail 128. The stacking tray and slide rail assembly further includes a bidirectional motor and drive controller (not shown) to regulate the vertical position of the stacking tray.

Figure 3:
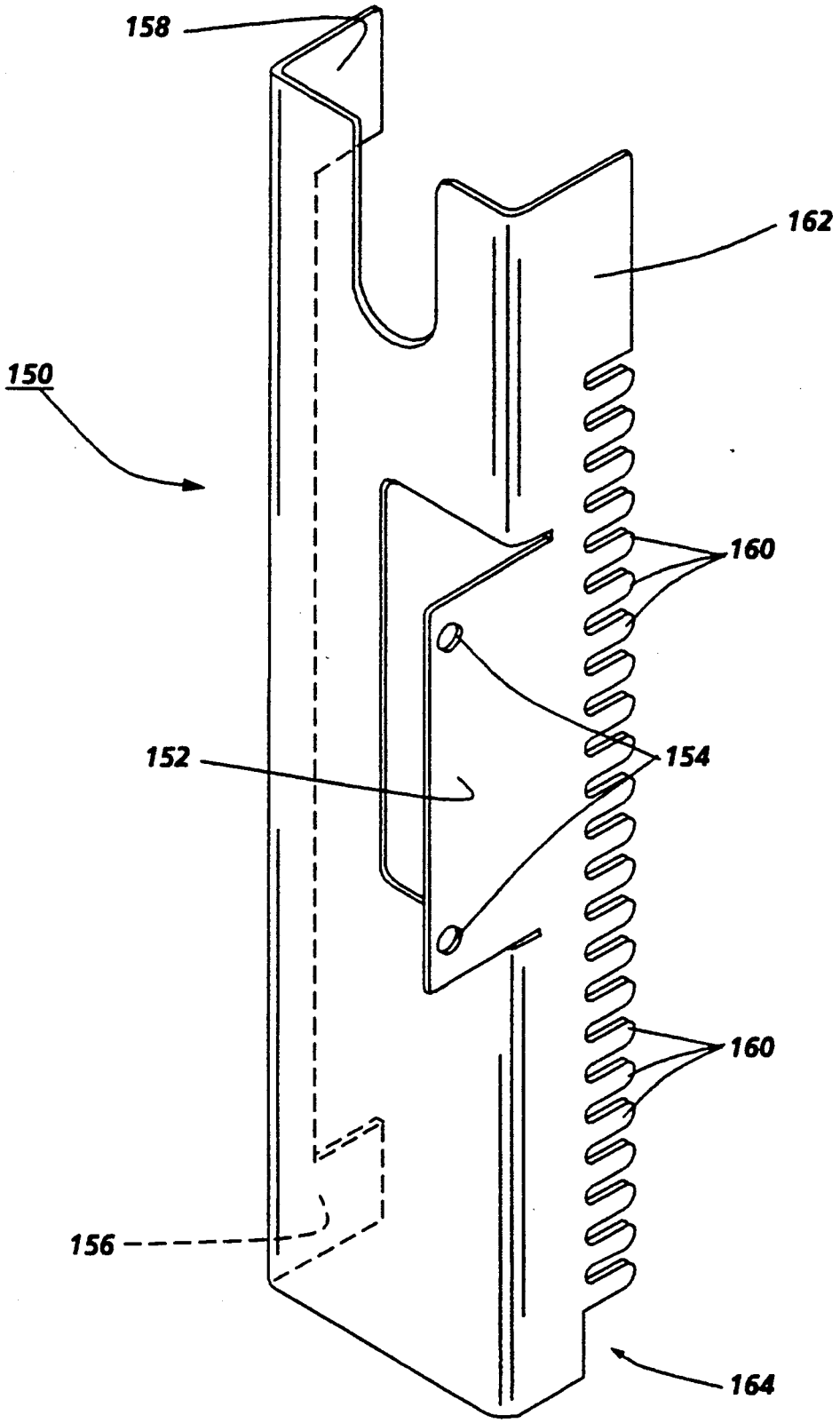
FIG. 3 is a perspective view depicting the sensor actuator apparatus used to enable a drive controller to monitor the position of the stacking tray of the FIG. 2 finishing station.

Referring also to FIG. 3, a sensor actuating apparatus with a U-shaped frame, generally referred to by reference numeral 150, is operatively attached to slide 126. The sensor actuating apparatus is attached to slide 126 by way of fastening tab 152, with suitable fastening means located in holes 154, whereby the sensor actuating apparatus is responsive to the vertical displacement of the slide and attached stacking tray. In addition, attached to output transport assembly 104 is travel limit sensor 134, whereby the travel limit sensor is responsive to upper travel limit tab 156 or lower travel limit tab 158, formed on the first leg of the U-shaped frame. Displacement of the actuator in a fashion suitable to cause actuation of the travel limit sensor, will result in a signal being transmitted from the travel limit sensor to the drive controller, whereby the drive controller disables further upward movement. Likewise, downward movement of the slide and attached actuator will result in activation of the travel limit sensor by lower travel limit tab 158, similarly causing the controller to inhibit further descent of the stacking tray.

Also attached to output transport assembly 104 is motion sensor 132, whereby the motion sensor is responsive to displacement of sensor actuating apparatus 150, as indicated by the passage of evenly spaced comb-like tabs, or teeth, 160, through the active sensing region of the motion sensor. Displacement of the comb-like tabs, disposed on the second leg of the U-shaped frame of the sensor actuating apparatus 150, will result in the generation of an alternating signal by motion sensor 132, fed to the drive controller. The alternating signal generated by the displacement of the comb-like tabs, relative to motion sensor 132, enables the drive controller to accurately track the relative vertical position of the sensor actuating apparatus, and thereby determine the relative position of the stacking tray. Furthermore, the second leg of the U-shaped frame also includes an elongated solid tab, 162, disposed in a manner so as to cause the actuation of motion sensor 132 at the same time as lower travel limit tab 158 actuates travel limit sensor 134. The combination of the two active signals enables the drive controller to determine that the stacking tray is positioned at the lower travel limit, thus causing the controller to disable further descent of the tray. Similarly, the lower end of the second U-shaped leg, in an open area generally referred to by reference numeral 164, there are no tabs to actuate motion sensor 132. The vertical position of the open area corresponds with the position of upper travel limit tab 156. Actuation of travel limit sensor 134 by upper travel limit tab 156 causes an active signal to be output from the travel limit sensor. This active signal, in conjunction with the inactive signal from motion sensor 132, caused by open area 164, enables the drive controller to determine that the upper travel limit has been reached and to disable further ascent of the stacking tray.

In general, vertical displacement of the stacking tray is initiated by the drive controller in response to signals from the top of stack sensors. Subsequently, operation of the bidirectional drive is initiated by the drive controller to effect the movement of the stacking tray to a new desired elevation. The drive controller then concurrently monitors the signals from the travel limit sensor and the motion sensor to determine when the stacking tray has traveled the desired distance, or has reached an upper or lower travel limit. Upon determining that the tray has reached the new position, the drive controller causes the bidirectional drive to cease movement and awaits further signals from the top of stack sensors.

In recapitulation, the apparatus of the present invention includes a travel limit sensor for sensing the presence of an output stacking tray at its maximum upper and lower travel limits, a motion sensor for sensing incremental vertical displacement of the stacking tray, and a sensor actuating apparatus. The sensor actuating apparatus being operatively connected to the stacking tray and having tabs extending therefrom to cause the actuation of the travel limit sensor when the stacking tray is at either the upper or lower travel limit. The sensor actuating means also having a plurality of evenly spaced comb-like tabs extending therefrom so as to cause the periodic actuation of the motion sensor, whereby the signal generated by the motion sensor in response to said actuation is representative of relative incremental motion of the stacking tray.

It is, therefore, evident that there has been provided, in accordance with the present invention, an apparatus that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

We claim:

1. An apparatus for maintaining an outermost sheet of a stack of sheets at a selected position of the type having a tray for holding the stack, a drive system adapted to move the tray, a position sensor detecting the position of the outermost sheet of the stack, and means for controlling the drive system in response to signals received from the position sensor so as to move the outermost sheet of the stack to a predetermined location, wherein the improvement comprises:

first means for sensing the tray at a first selected position and at a second selected position, spaced from the first selected position, said first sensing means transmitting a signal to the controlling means indicating that the tray is at the first selected position or the second selected position, which inhibits movement of the tray and causes the drive system to reverse the direction of subsequent movement of the tray;

second means for sensing motion of the tray, so that a signal, indicative of movement of the tray, is sent from said second sensing means to the controlling means;

a frame, operatively associated with the tray, said frame being adapted to move in unison with the tray;

a first sensor actuator, located on said frame and extending outwardly therefrom, for positively actuating said first sensing means in response to the tray being positioned at the first selected position; and a second sensor actuator, located on said frame and extending outwardly therefrom, for positively actuating said first sensing means in response to the tray being positioned at the second selected position; and a plurality of uniformly spaced elements, located on said frame, to actuate said second sensing means in response to movement of the tray, so that said second sensing means transmits an alternating binary signal, indicative of movement of the tray, to the controlling means enabling the controlling means to monitor the location of the tray.

2. The apparatus of claim 1, wherein;

said first sensor actuator comprises a first tab; and said second sensor actuator comprises a second tab, spaced from said first tab.

3. The apparatus of claim 1, wherein said uniformly spaced elements comprise, a comb integrally connected to said frame and extending therefrom, said comb including a plurality of teeth of equal width, said teeth defining apertures therebetween, the width of said apertures equaling the width of said teeth, whereby the teeth of said comb actuate said second sensing means.

4. The apparatus of claim 3, wherein said comb further comprises;

a solid tab, disposed at one end thereof and in alignment with said teeth, to actuate said second sensing means when the tray is located at said first selected position, to enable the controlling means to further distinguish the location of the tray at either the first selected position or the second selected position.

5. The apparatus of claim 1, wherein the controlling means further comprises:

means, responsive to the signal generated by the first sensing means and the signal generated by the second sensing means, for determining whether the tray is located at the first selected position or the second selected position.

6. The apparatus of claim 1, wherein the first sensing means further comprises a binary switch which indicates the presence of said first sensor actuator or said second sensor actuator within an active sensing region of said switch by an active signal, and otherwise outputs an inactive signal, said controlling means being responsive to the active signal from said switch.

7. The apparatus of claim 6, wherein said binary switch further comprises an optical switch.

8. The apparatus of claim 1, wherein the second sensing means further comprises a binary switch which indicates the presence of said second actuating means within an active sensing region of said binary switch by an active signal, and otherwise outputs an inactive signal, thereby enabling the controlling means to directly monitor the incremental movement of the tray as indicated by the alternating signal from said second sensing means.

9. The apparatus of claim 8, wherein said binary switch further comprises an optical switch.

10. An electrophotographic printing machine of the type in which successive copy sheets, having indicia recorded thereon are advanced to a finishing station having a tray for holding a stack of the copy sheets, a drive system adapted to move the tray in a vertical direction, a position sensor detecting the position of the uppermost copy sheet of the stack of the copy sheets on the tray, and means for controlling the drive system in response to signals received from the position sensor so as to maintain the uppermost copy sheet of the stack at a predetermined location, wherein the improvement comprises:

first means for sensing the tray at a first selected position and at a second selected position, spaced from the first selected position, said first sensing means transmitting a signal to the controlling means indicating that the tray is at the first selected position or the second selected position, which inhibits movement of the tray and causes the drive system to reverse the direction of subsequent movement of the tray;

second means for sensing motion of the tray, so that a signal, indicative of movement of the tray, is sent from said second sensing means to the controlling means;

a frame, operatively associated with the tray, said frame being adapted to move in unison with the tray;

a first sensor actuator, located on said frame and extending outwardly therefrom, for positively actuating said first sensing means in response to the tray being positioned at the first selected position; and a second sensor actuator, located on said frame and extending outwardly therefrom, for positively actuating said first sensing means in response to the tray being positioned at the second selected position; and a plurality of uniformly spaced elements, located on said frame, to actuate said second sensing means in response to movement of the tray, so that said second sensing means transmits an alternating binary signal, indicative of movement of the tray, to the controlling means enabling the controlling means to monitor the location of the tray.

11. The electrophotographic printing machine of claim 10 wherein;

said first sensor actuator comprises a first tab; and said second sensor actuator comprises a second tab, spaced from said first tab.

12. The electrophotographic printing machine of claim 10, wherein said uniformly spaced elements comprise, a comb integrally connected to said frame and extending therefrom, said comb including a plurality of teeth of equal width, said teeth defining apertures therebetween, the width of said apertures equaling the width of said teeth, whereby the teeth of said comb actuate said second sensing means.

13. The electrophotographic printing machine of claim 12, wherein said comb further comprises;

a solid tab, disposed at one end thereof and in alignment with said teeth, to actuate said second sensing means when the tray is located at said first selected position, to enable the controlling means to further distinguish the location of the tray at either the first selected position or the second selected position.

14. The electrophotographic printing machine of claim 10, wherein the controlling means further comprises:

means, responsive to the signal generated by the first sensing means and the signal generated by the second sensing means, for determining whether the tray is located at the first selected position or the second selected position.

15. The electrophotographic printing machine of claim 10, wherein the first sensing means further comprises a binary switch which indicates the presence of said first sensor actuator or said second sensor actuator within an active sensing region of said switch by an active signal, and otherwise outputs an inactive signal, said controlling means being responsive to the active signal from said switch.

16. The electrophotographic printing machine of claim 15, wherein said binary switch further comprises an optical switch.

17. The electrophotographic printing machine of claim 10, wherein the second sensing means further comprises a binary switch which indicates the presence of said second actuating means within an active sensing region of said binary switch by an active signal, and otherwise outputs an inactive signal, thereby enabling the controlling means to directly monitor the incremental movement of the tray as indicated by the alternating signal from said second sensing means.

18. The electrophotographic printing machine of claim 17, wherein said binary switch further comprises an optical switch.

* * * * *